US009168754B2

(12) United States Patent
Mano et al.

(10) Patent No.: US 9,168,754 B2
(45) Date of Patent: Oct. 27, 2015

(54) LIQUID EJECTION APPARATUS

(71) Applicant: SEIKO EPSON CORPORATION, Tokyo (JP)

(72) Inventors: Takashi Mano, Shiojiri (JP); Ryo Oguchi, Shiojiri (JP); Keigo Yamasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/451,804

(22) Filed: Aug. 5, 2014

(65) Prior Publication Data

US 2015/0042721 A1 Feb. 12, 2015

(30) Foreign Application Priority Data

Aug. 8, 2013 (JP) ..... 2013-165206

(51) Int. Cl.
*B41J 2/165* (2006.01)

(52) U.S. Cl.
CPC ..... *B41J 2/16541* (2013.01); *B41J 2/16538* (2013.01)

(58) Field of Classification Search
CPC ..... B41J 2/16541; B41J 2/16535; B41J 2/16538; B41J 2/16547; B41J 2/175; B41J 2/1721; B41J 2/16523
USPC ..... 347/33, 22, 29, 31, 36
See application file for complete search history.

(56) References Cited

U.S. PATENT DOCUMENTS

| | | | | |
|---|---|---|---|---|
| 6,467,873 | B1 * | 10/2002 | Toba et al. | 347/33 |
| 2007/0103505 | A1 | 5/2007 | Takagi | |
| 2013/0135386 | A1 * | 5/2013 | Kakigahara | 347/33 |

FOREIGN PATENT DOCUMENTS

| | | |
|---|---|---|
| JP | 07-089080 | 4/1995 |
| JP | 2005-349782 | 12/2005 |
| JP | 2007-055146 | 3/2007 |
| JP | 2007-152940 | 6/2007 |

* cited by examiner

*Primary Examiner* — Jannelle M Lebron
(74) *Attorney, Agent, or Firm* — Workman Nydegger

(57) ABSTRACT

A liquid ejection apparatus includes a liquid ejection unit including a nozzle formation surface in which an opening of a nozzle for ejecting liquid is formed; a wiper disposed so that the wiper can come in contact with the nozzle formation surface; and a liquid collection portion, which is capable of collecting liquid adhered to the wiper, disposed on an end side of the nozzle formation surface of the liquid ejection unit so as to be spaced apart from the nozzle formation surface in a wiping direction. The liquid collection portion includes a scraper having a scraping surface that scrapes off the liquid adhered to the wiper by coming in contact with the wiper, and a liquid absorbing material disposed at a position that does not come in contact with the wiper and at a position that comes in contact with an end portion of the scraping surface.

9 Claims, 7 Drawing Sheets

LIQUID EJECTION APPARATUS

BACKGROUND

1. Technical Field

The present invention relates to a liquid ejection apparatus, such as an ink jet printer.

2. Related Art

Generally, as a type of liquid ejection apparatus, an ink jet printer is known that carries out printing on a recording medium, such as a sheet of paper, by ejecting ink (liquid) from nozzles that are openings formed on a nozzle formation surface of a liquid ejecting head. Such a printer is normally provided with a head maintenance device for maintaining the ink ejection characteristics of the liquid ejection head.

Such a head maintenance device has various functions. For example, the head maintenance device has a function of recovering the ink ejection characteristics of the nozzles by capping the nozzle formation surface of the liquid ejection head with a suction cap and sucking the ink that has had an increase in viscosity from the nozzle with a suction pump. Furthermore, the head maintenance device has a function of sweeping off (wiping off) unnecessary ink adhered to the nozzle formation surface of the liquid ejection head with a wiper. Moreover, ink that has been swept off and that has adhered to the wiper is absorbed by an ink absorbing material (a liquid absorbing material).

Hitherto, a printer disclosed in JP-A-2007-152940 is a known printer that is provided with such a wiper and an ink absorbing material. In such a printer, a head body (a liquid ejection head) is supported by a holder and ink adhered to an ink discharge surface (a nozzle formation surface) is swept off so as to be captured by the wiper by displacing the wiper in a wiping direction while the wiper is abutted against an ink discharge surface of the head body. Then, the ink adhered to the wiper is absorbed by the ink absorbing material attached to the holder.

In the printer described above, the ink adhered to the wiper is absorbed by the ink absorbing material by making the wiper come in contact with the ink absorbing material. Accordingly, there is a problem in that the performance of the wiper may be degraded due to adhesion of a fragment of the liquid absorbing material and adhesion of ink, which had been absorbed by the liquid absorbing material and which has solidified, to the wiper.

Note that this kind of problem is not limited to ink jet printers and is generally common in liquid ejection devices provided with a wiper that sweeps off liquid adhered to a nozzle formation surface of a liquid ejection head and a liquid absorbing material that absorbs liquid adhered to the wiper.

SUMMARY

The invention has been made in view of the above problems that exist in known techniques. An advantage of some aspects of the invention is to provide a liquid ejection apparatus capable of absorbing liquid adhered to the wiper with a liquid absorbing material while suppressing degradation of the wiper performance.

Hereinafter, a liquid ejection apparatus addressed to solve the above problems and effects of the liquid ejection apparatus will be described.

An aspect of a liquid ejection apparatus for solving the above problems include a liquid ejection unit that includes a nozzle formation surface, the nozzle formation surface having an opening of a nozzle for ejecting liquid formed therein; a wiper disposed so as to be capable of coming in contact with the nozzle formation surface; a transport member capable of relatively displacing the liquid ejection unit and the wiper in a wiping direction that extends along the nozzle formation surface; a controller that controls the transport member such that the wiper is relatively displaced from one end to the other end of the nozzle formation surface in the wiping direction while the wiper is in contact with the nozzle formation surface; a liquid collection portion disposed on the other end side of the nozzle formation surface of the liquid ejection unit so as to be spaced apart from the nozzle formation surface in the wiping direction, the liquid collection portion being capable of collecting the liquid adhered to the wiper; and the liquid collection portion including a scraper having a scraping surface that scrapes off the liquid adhered to the wiper by coming in contact with the wiper, and the liquid absorbing material that is disposed at a position that does not come in contact with the wiper and at a position that comes in contact with an end portion of the scraping surface.

According to the above configuration, the liquid adhered to the wiper is scraped off by the scraping surface and adheres to the scraping surface. Then, the liquid that has adhered to the scraping surface is absorbed by the liquid absorbing material from the end portion of the scraping surface. Accordingly, the liquid adhered to the wiper is absorbed by the liquid absorbing material without the wiper and the liquid absorbing material coming in contact with each other. Accordingly, a fragment of the liquid absorbing material and the liquid, which had been absorbed by the liquid absorbing material and which has solidified, do not adhere to the wiper. As a result, the liquid adhered to the wiper can be absorbed by the liquid absorbing material while suppressing degradation of the wiping performance of the wiper.

It is preferable that in the liquid ejection apparatus described above, the liquid ejection unit includes a liquid ejection head having the nozzle formation surface and a box shape carriage having a bottom, the box shape carriage supporting the liquid ejection head such that the nozzle formation surface is exposed through an opening formed in a bottom wall of the carriage. It is further preferable that the liquid absorbing material is disposed in the carriage such that the liquid absorbing material is in contact with the end portion of the scraping surface through the opening.

According to the above configuration, since the liquid absorbing material is disposed in the carriage, the liquid that has been absorbed by the liquid absorbing material can be suppressed from dripping down.

It is preferable that in the liquid ejection apparatus described above, the liquid absorbing material has a plate shape and is disposed such that, among the plurality of surfaces of the liquid absorbing material, a surface that has a relatively large area is in contact with an inner bottom surface of the carriage.

According to the above configuration, retention of liquid in the liquid absorbing material can be facilitated.

It is preferable that in the liquid ejection apparatus described above, the end portion of the scraping surface on the liquid absorbing material side is chamfered.

According to the above configuration, since a gap is formed between the chamfered portion of the scraping surface and the liquid absorbing material, liquid accumulates in the gap; accordingly, the liquid adhered to the scraping surface can be guided to the liquid absorbing material more easily.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an exemplary embodiment, which is an ink jet printer embodying the liquid ejection apparatus, will be described with reference to the drawings.

Figure 1:
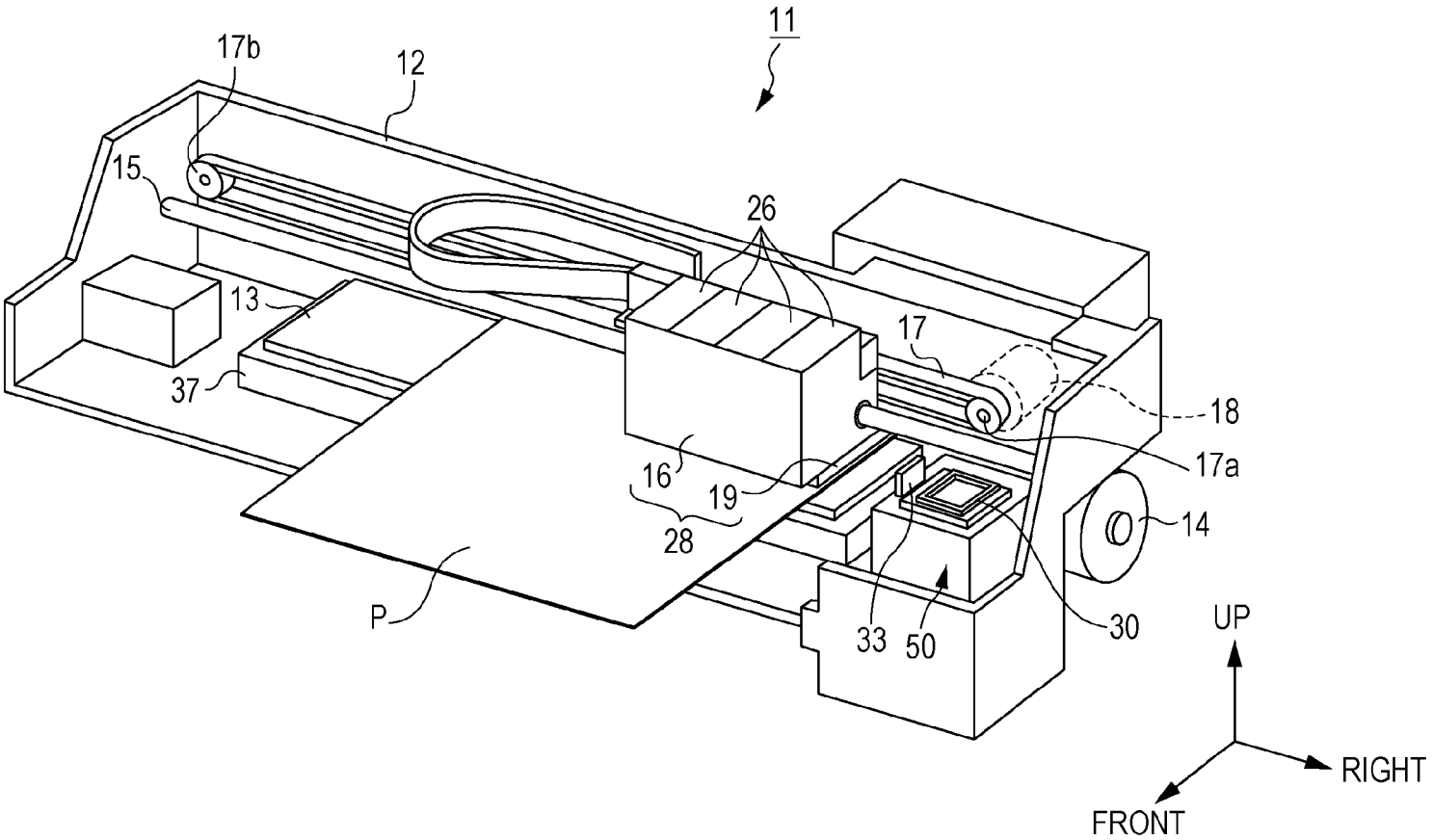
FIG. 1 is a perspective view of an ink jet printer according to an exemplary embodiment.

As illustrated in FIG. 1, an ink jet printer 11 serving as an example of the liquid ejection apparatus includes a substantially box-shaped main body case 12 that has a substantially rectangular box shape. A support base 13 is provided at a lower portion inside the main body case 12 so as to extend in the left-right direction, which is the longitudinal direction of the main body case 12. A sheet P is fed from the rear side of the main body case 12 onto the support base 13 with a sheet feeding mechanism (not shown) that is driven by a sheet feeding motor 14 provided at a lower rear portion of the main body case 12.

A guide shaft 15 is installed inside the main body case 12 and above the support base 13 in the left-right direction, which is the longitudinal direction of the support base 13. A carriage 16 is supported by the guide shaft 15 so as to be allowed to reciprocate along the guide shaft 15. A driving pulley 17*a* and a driven pulley 17*b* are provided so as to be supported in a rotatable manner on an inner surface of a rear wall of the main body case 12 at positions corresponding to the two end portions of the guide shaft 15.

An output shaft of a carriage motor 18, the carriage motor 18 serving as an example of a transport member that is a driving source for reciprocating the carriage 16 in the left-right direction, is connected to the driving pulley 17*a*. An endless timing belt 17, of which a portion is connected to the carriage 16, is wound around the pair of pulleys 17*a* and 17*b*.

As configured as above, the drive of the carriage motor 18 displaces the carriage 16 in the left-right direction via the endless timing belt 17 while the carriage 16 is guided by the guide shaft 15. Note that the carriage 16 is provided with a linear encoder 29 (see FIG. 6) that detects the position of the carriage 16.

Figure 2:
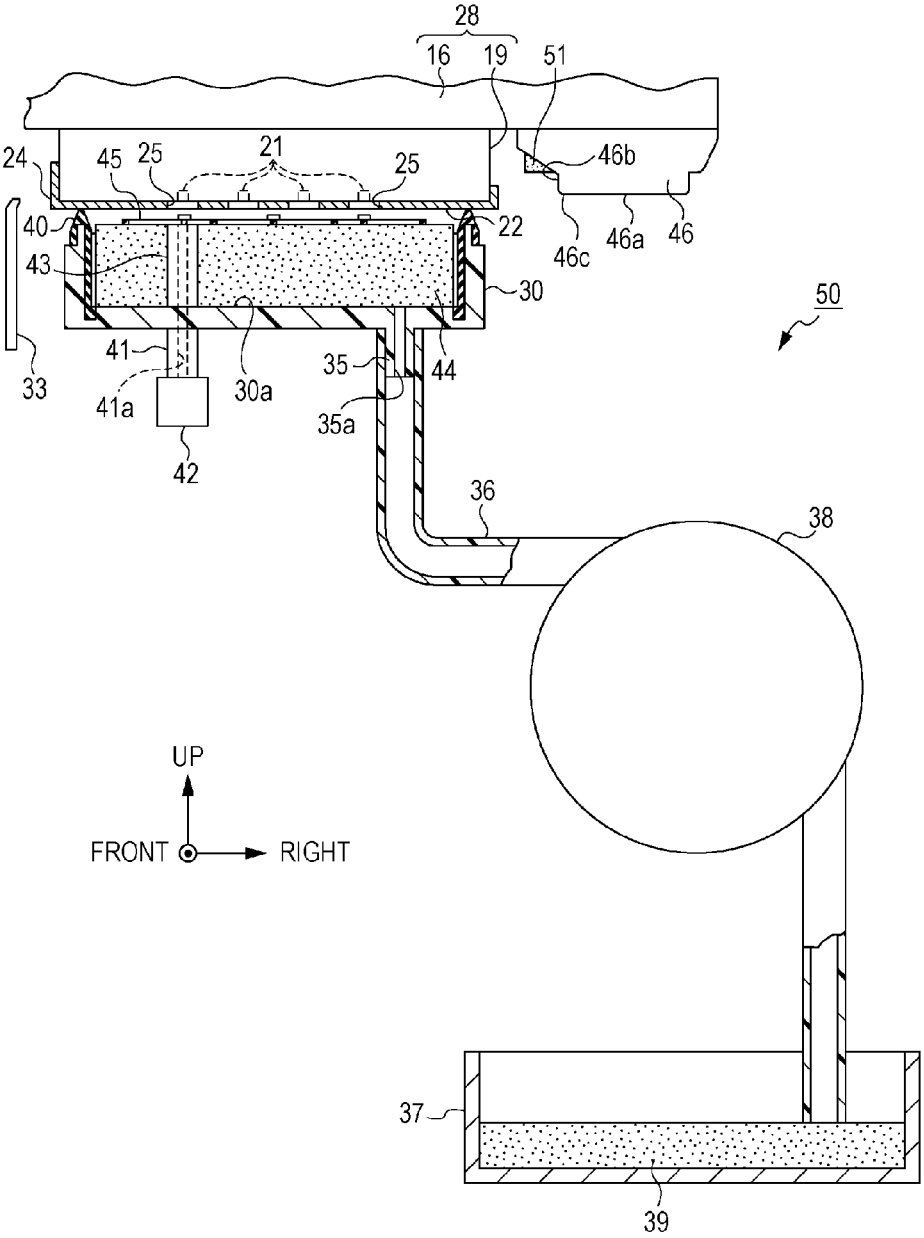
FIG. 2 is a cross-sectional schematic diagram of a maintenance mechanism of the printer.
Figure 4:
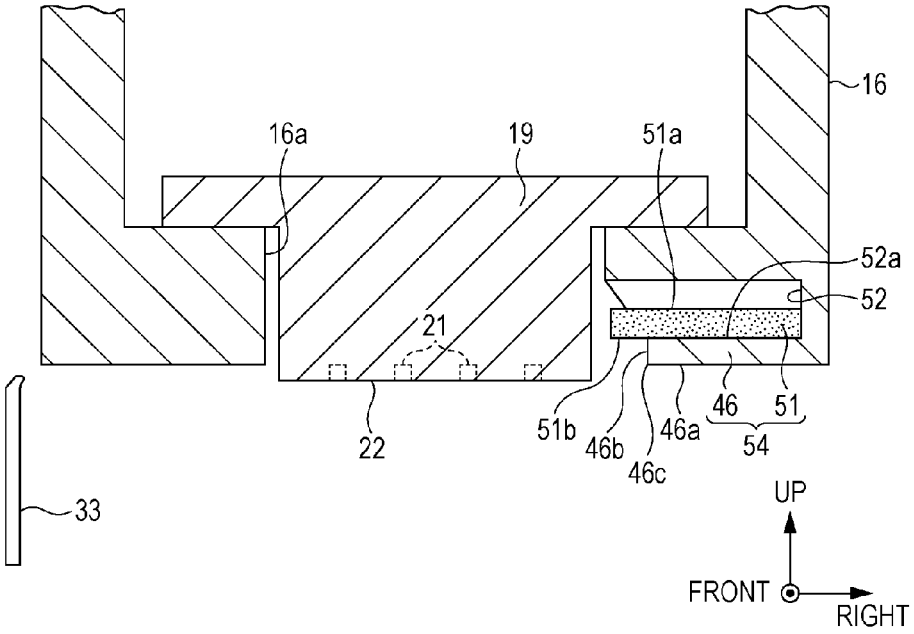
FIG. 4 is a cross-sectional schematic diagram of the liquid ejection unit.

As illustrated in FIGS. 2 and 4, the carriage 16 has a rectangular box shape having a bottom. An opening 16*a* is formed in a middle portion of a bottom wall of the carriage 16 such that the inside and the outside of the carriage 16 are in communication with each other. A liquid ejection head 19 is provided in the carriage 16. The liquid ejection head 19 is supported by the carriage 16 so as to be exposed through the opening 16*a*. A rectangular shaped bottom surface of the liquid ejection head 19 is exposed to a bottom surface side of the carriage 16 through the opening 16*a*. Furthermore, the bottom surface of the liquid ejection head 19 serves as a nozzle formation surface 22 in which openings of a plurality of nozzles 21, which eject ink serving as an example of the liquid, are formed.

Figure 3:
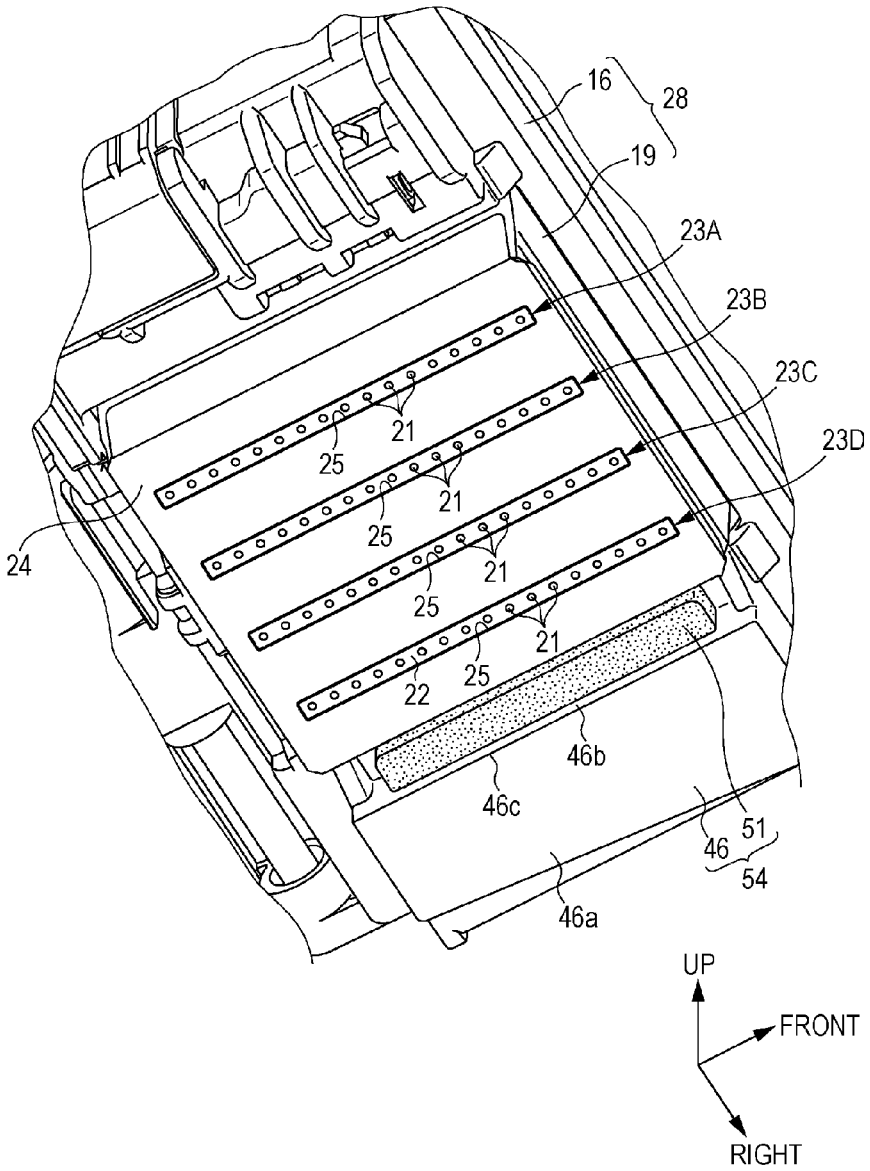
FIG. 3 is an enlarged perspective view of a main portion of a liquid ejection unit of the printer.

As illustrated in FIGS. 2 and 3, a plurality of (four in the exemplary embodiment) rows of nozzles that are each constituted by a plurality of nozzles 21 aligned in the front-rear direction are arranged in the middle portion of the nozzle formation surface 22 in the left-right direction at regular intervals. The four nozzle rows are referred to as, in order from left to right, a nozzle row 23A, a nozzle row 23B, a nozzle row 23C, and a nozzle row 23D.

Furthermore, a rectangular plate-shaped cover head 24 is attached to the liquid ejection head 19 so as to cover the entire nozzle formation surface 22. The left and right end portions of the cover head 24 are bent and are in contact with the left and right lateral surfaces of the liquid ejection head 19. Furthermore, cover openings 25 for exposing the nozzle rows 23A to 23D are formed in the cover head 24 at positions corresponding to the nozzle rows 23A to 23D.

As illustrated in FIGS. 1 and 2, a plurality of (four in the exemplary embodiment) ink cartridges 26 for supplying ink to the liquid ejection head 19 are attached on the carriage 16 in an attachable/detachable manner. Inks of different colors are retained in the ink cartridges 26. Each ink includes glycerin and betaine serving as humectants. Each ink is supplied to the liquid ejection head 19 from the corresponding ink cartridge 26 by driving piezoelectric elements 27 (see FIG. 6) that are provided in the liquid ejection head 19.

Furthermore, the ink that has been supplied to the liquid ejection head 19 is ejected from the plurality of nozzles 21, which are formed in the nozzle formation surface 22 of the liquid ejection head 19, onto the sheet P that has been transported onto the support base 13; accordingly, printing is carried out on the sheet P. Note that in the exemplary embodiment, the carriage 16 and the liquid ejection head 19 constitute a liquid ejection unit 28.

Furthermore, a maintenance mechanism 50 that carries out maintenance of the liquid ejection head 19, such as cleaning and wiping, during nonprinting periods is provided in a home position area (non-printing area), that is, in the right end portion inside the main body case 12 at a position that does not correspond to the position of the sheet P.

The maintenance mechanism 50 will be described in detail next.

As illustrated in FIG. 2, the maintenance mechanism 50 includes a cap 30 that has a square box shape with a bottom that can receive the ink ejected from the liquid ejection head 19 and a cap elevating mechanism 32 (see FIG. 6) that elevates/lowers the cap 30. The cap 30 is provided with a sealing member 40 formed of a square frame-shaped elastomer that covers the inside surface and the upper end portion of the cap 30.

Furthermore, in a state in which the carriage 16 is displaced to the home position area, by elevating the cap 30 with the cap elevating mechanism 32 (see FIG. 6), the cap 30 is made to abut against the cover head 24 that is attached to the liquid ejection head 19 such that each of the nozzles 21 is covered. In other words, the cap 30 is abutted against the nozzle formation surface 22 with the cover head 24 therebetween such that each of the nozzles 21 is covered.

Furthermore, the maintenance mechanism 50 includes a substantially rectangular plate-shaped wiper 33 that is arranged on the left side of the cap 30 and that is capable of wiping (sweeping) the nozzle formation surface 22 of the liquid ejection head 19 and a wiper elevating mechanism 34 (see FIG. 6) that elevates/lowers the wiper 33. The wiper 33 includes a flexible material, such as rubber or elastomer.

Furthermore, in a state in which the wiper 33 is elevated with the wiper elevating mechanism 34 (see FIG. 6) to a position allowing the wiper 33 to come in contact with the nozzle formation surface 22 of the liquid ejection head 19, the carriage 16 is displaced from the right side, which is the home position area side, towards the left side, which is the print area side where printing is carried out; accordingly, the nozzle formation surface 22 is wiped by the wiper 33. In other words, by displacing the carriage 16, the wiper 33 is relatively displaced over the nozzle formation surface 22 in a wiping direction, which is a direction that is oriented along the nozzle formation surface 22 from the left side to the right side; accordingly, the nozzle formation surface 22 is wiped by the wiper 33.

A first projection 35 that projects downwards is provided in the right portion of the bottom wall of the cap 30. A discharge passage 35*a* that discharges ink from inside the cap 30 is provided in the first projection 35 so as to penetrate the first projection 35 in the up-down direction. A proximal end side of a discharge tube 36, in other words, the upstream side of the discharge tube 36, that is formed of a flexible material is connected to the first projection 35. On the other hand, a distal end side of the discharge tube 36, in other words, the downstream side of the discharge tube 36, is inserted into a waste ink tank 37 that has a rectangular parallelepiped shape.

A tube pump 38 that sucks the inside of the cap 30 from the cap 30 side towards the waste ink tank 37 side is disposed in the middle portion of the discharge tube 36 that is provided between the cap 30 and the waste ink tank 37.

Furthermore, in a state in which the cap 30 is abutted against the nozzle formation surface 22 of the liquid ejection head 19 so that the cap 30 covers each of the nozzles 21 with the cover head 24 therebetween, the tube pump 38 is driven. With the above, ink with increased viscosity is sucked out together with bubbles and the like from each nozzle 21 and is discharged into the waste ink tank 37 through the inside of the cap 30, the discharge passage 35*a*, and the discharge tube 36; accordingly, cleaning is carried out. Note that a waste ink absorbing material 39 that absorbs the ink discharged into the waste ink tank 37 and that retains the discharged ink therein is accommodated inside the waste ink tank 37.

Furthermore, a second projection 41 that projects downwards is provided in the left portion of the bottom wall of the cap 30. An atmospheric release passage 41*a* that opens the cap 30 to the atmosphere is provided in the second projection 41 so as to penetrate the second projection 41 in the up-down direction. An atmospheric release valve 42 is provided at the lower end of the second projection 41 that is the distal end thereof. Furthermore, when the atmospheric release valve 42 is open, the atmospheric release passage 41*a* is in communication with the atmosphere, and when the atmospheric release valve 42 is closed, the atmospheric release passage 41*a* is cut off from the atmosphere.

A cylindrical atmospheric release pipe 43, whose inside is in communication with the atmospheric release passage 41*a*, is provided in an erect manner through an inner bottom surface 30*a* of the cap 30 at a position that corresponds to the second projection 41. The upper end of the atmospheric release pipe 43 is open to the inside of the cap 30. A rectangular plate-shaped porous ink absorbing material 44 that is capable of absorbing ink is accommodated in the cap 30.

A stainless steel restriction member 45 is disposed in the cap 30 on an upper surface of the ink absorbing material 44 that opposes the nozzle formation surface 22. The restriction member 45 restricts the ink absorbing material 44 from coming in contact with the nozzle formation surface 22 of the liquid ejection head 19 and the cover head 24, which is caused by the ink absorbing material 44 deforming due to swelling or by the ink absorbing material 44 floating up. Note that the position of the upper surface of the restriction member 45 is lower than the position of the upper end surface of the sealing member 40 of the cap 30.

As illustrated in FIGS. 2 and 3, a scraper 46 that comes in contact with the wiper 33 to scrape off the ink adhered to the wiper 33 after the wiper 33 has wiped the nozzle formation surface 22 is provided on the bottom surface of the carriage 16 and on the right side of the liquid ejection head 19, which is on the home position area side. In other words, the scraper 46 is disposed on the right side of the nozzle formation surface 22 in the wiping direction with a space between itself and the nozzle formation surface 22.

The scraper 46 includes a smooth and rectangular bottom surface 46*a* that extends horizontally and a rectangular scraping surface 46*b* that is a surface on the left side of the scraper 46 that opposes a surface on the right side of the liquid ejection head 19. Accordingly, a corner portion 46*c* that extends in the front-rear direction, which is a direction orthogonal to the direction of displacement of the carriage 16, is formed in the boundary between the bottom surface 46*a* and the scraping surface 46*b* of the scraper 46. Note that the position of the bottom surface 46*a* of the scraper 46 is slightly higher than the position of the nozzle formation surface 22.

Figure 5:
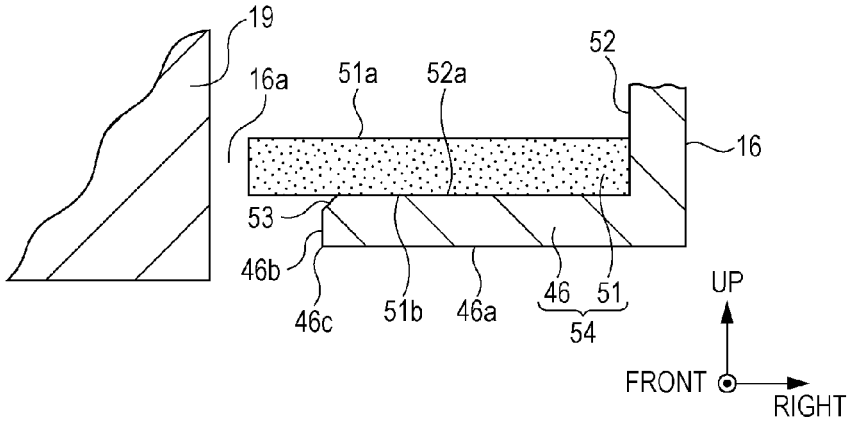
FIG. 5 is an enlarged schematic diagram of a main portion of FIG. 4.

As illustrated in FIGS. 4 and 5, inside the carriage 16, an accommodation recess 52 that accommodates therein a porous liquid absorbing material 51 that is capable of absorbing ink and retaining ink therein is provided adjacent to the scraper 46 in the up-down direction and in the right end portion of the bottom wall of the carriage 16. The accommodation recess 52 is open on the left side, which is the liquid ejection head 19 side. Furthermore, a bottom surface 52*a* inside the accommodation recess 52 constitutes a portion of an inner bottom surface of the carriage 16.

The liquid absorbing material 51 has a rectangular thin-plate-shape with six sides. Among the six sides, an upper surface 51*a* and a bottom surface 51*b* have relatively large areas with respect to the other sides. Furthermore, the liquid absorbing material 51 is disposed inside the accommodation recess 52 such that the bottom surface 51*b* is in contact with the bottom surface 52*a* inside the accommodation recess 52. In other words, the liquid absorbing material 51 is disposed at a position that does not come in contact with the wiper 33. In the above case, a left end portion of the liquid absorbing material 51, which is an end portion of the liquid absorbing material 51 on the liquid ejection head 19 side, protrudes from the opening of the accommodation recess 52.

Accordingly, the liquid absorbing material 51 is disposed at a position that allows the liquid absorbing material 51 to be in contact with the end portion of the scraping surface 46*b* through the opening 16*a*. In other words, an upper end portion of the scraping surface 46*b*, which is an end portion of the scraping surface 46*b* on the liquid absorbing material 51 side, is in contact with the bottom surface 51*b* of the liquid absorbing material 51. Accordingly, a corner portion is formed by the bottom surface 51*b* of the liquid absorbing material 51 and the scraping surface 46*b*.

Furthermore, the upper end portion of the scraping surface 46*b* is provided with a C-chamfer. Accordingly, a groove 53 that has a rectangular cross-sectional shape and that extends in the front-rear direction, which is a direction orthogonal to the direction of displacement of the carriage 16, is formed in the corner portion of the upper end portion of the scraping surface 46*b* and the bottom surface 51*b* of the liquid absorbing material 51. Note that in the exemplary embodiment, the scraper 46 and the liquid absorbing material 51 constitute a liquid collection portion 54 that is capable of collecting ink adhered to the wiper 33 (see FIG. 2).

An electrical configuration of an ink jet printer 11 will be described next.

Figure 6:
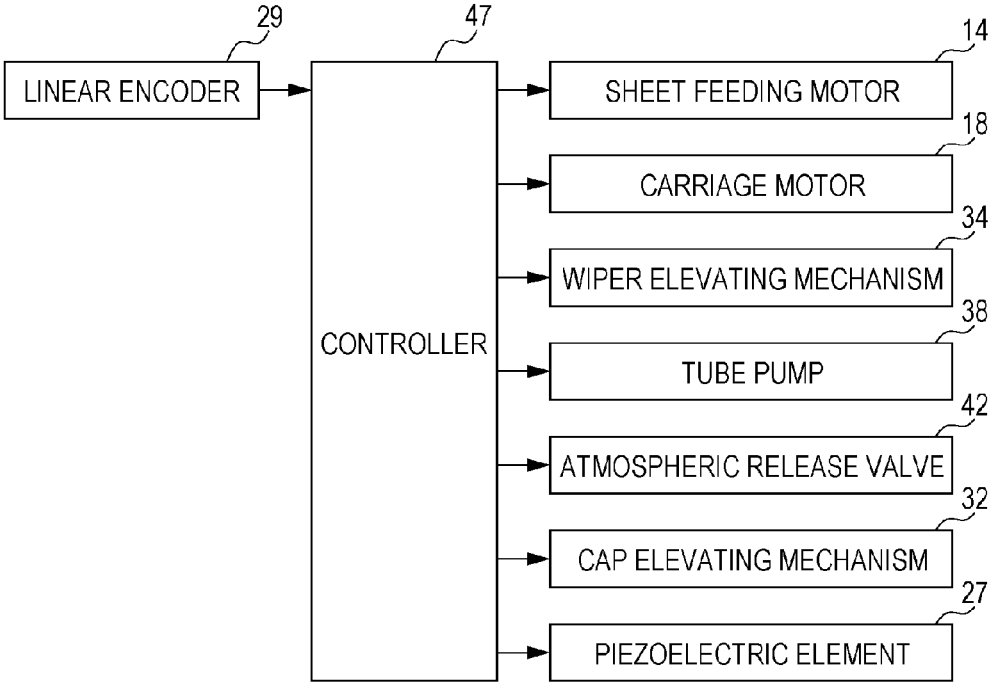
FIG. 6 is a block diagram illustrating an electrical configuration of the printer.

As illustrated in FIG. 6, the ink jet printer 11 (see FIG. 1) includes a controller 47 that integrally controls the ink jet printer 11. The linear encoder 29 is electrically coupled to an input-side interface (not shown) of the controller 47. Furthermore, the controller 47 determines the position of the carriage 16 based on an electrical signal output from the linear encoder 29.

On the other hand, the sheet feeding motor 14, the carriage motor 18, the wiper elevating mechanism 34, the tube pump 38, the atmospheric release valve 42, the cap elevating mechanism 32, and the piezoelectric elements 27 are each electrically coupled to an output-side interface (not shown) of the controller 47. Furthermore, the controller 47 controls the drive of each of the sheet feeding motor 14, the carriage motor 18, the wiper elevating mechanism 34, the tube pump 38, the atmospheric release valve 42, the cap elevating mechanism 32, and the piezoelectric elements 27.

The function of the maintenance mechanism 50 will be described next.

Now, as illustrated in FIG. 2, when cleaning the liquid ejection head 19, in a state in which the carriage 16 is displaced to the home position area, the cap 30 is elevated first so that the cap 30 is in contact with the nozzle formation surface 22 of the liquid ejection head 19 and so that each of the nozzles 21 are covered by the cap 30, with the cover head 24 therebetween.

Subsequently, the tube pump 38 is driven so that the inside of the cap 30 is sucked and becomes negative in pressure. The negative pressure discharges the ink with increased viscosity together with bubbles and the like that are inside each nozzle 21 into the waste ink tank 37 through the inside of the cap 30, the discharge passage 35*a*, and the discharge tube 36; accordingly, cleaning is completed. At this time, ink adheres to the nozzle formation surface 22 and the cover head 24.

Then, after cleaning is completed, in other words, after the suction of ink from each of the nozzles 21 of the liquid ejection head 19 is completed, idle suction that discharges residual ink inside the cap 30 is carried out by driving the tube pump 38 while the atmospheric release valve 42 is open. With the above, ink that has been absorbed and retained in the ink absorbing material 44 is discharged from the discharge passage 35*a* together with the air flowing into the cap 30 from the atmospheric release passage 41*a*. After the idle suction process is completed, the cap 30 is lowered such that the cap 30 is separated from the nozzle formation surface 22 of the liquid ejection head 19.

Subsequently, wiping, which sweeps off the ink adhered to the nozzle formation surface 22 and the cover head 24 with the wiper 33, is carried out. When the above wiping is carried out, the wiper 33 is elevated first such that the wiper 33 is adjusted to a height that allows the nozzle formation surface 22 and the wiper 33 to interfere with each other.

Figure 7:
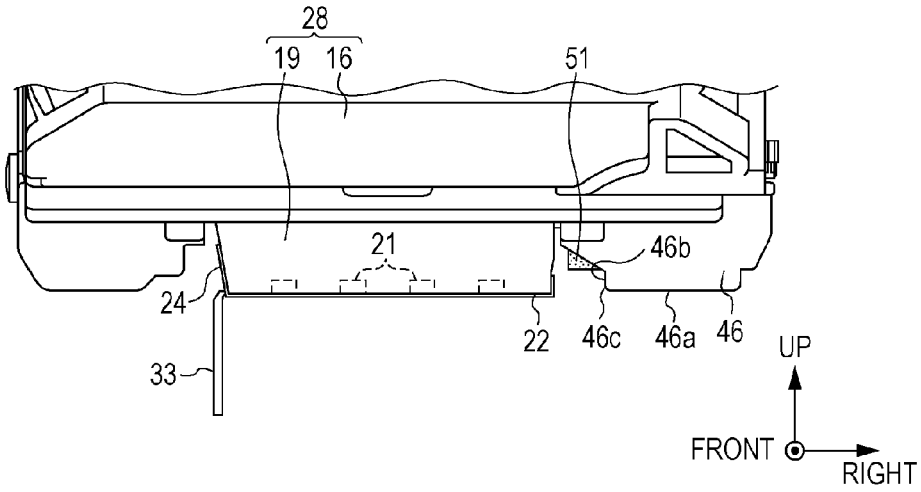
FIG. 7 is a schematic diagram illustrating a state in which a wiper is in contact with a left end of a nozzle formation surface of a liquid ejection head with a cover head therebetween.
Figure 8:
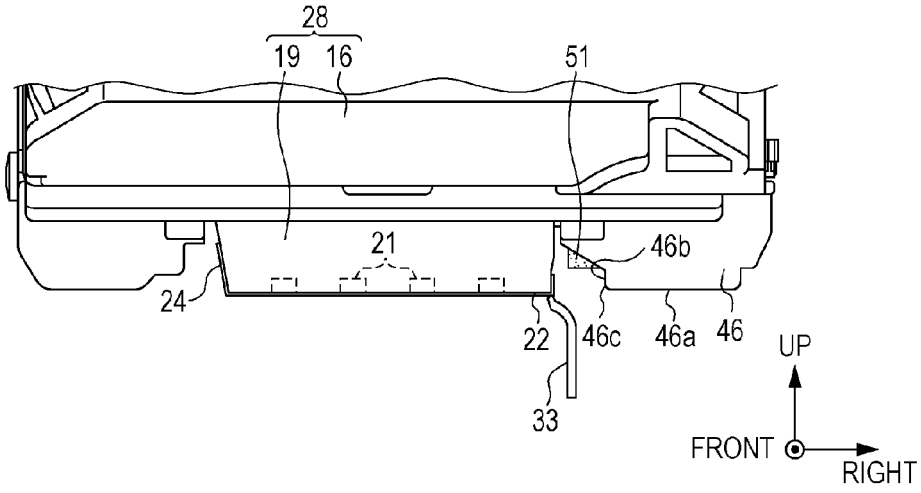
FIG. 8 is a schematic diagram illustrating a state in which the liquid ejection unit is displaced so that the wiper is relatively displaced to a right end of the nozzle formation surface while the wiper is in contact with the nozzle formation surface of the liquid ejection head with the cover head therebetween.

Subsequently, while the wiper 33 is in a stationary state, the carriage 16 is displaced from the right side, which is the home position area side, towards the left side, which is the print area side where printing is carried out. Accordingly, as illustrated in FIG. 7, the upper end portion of the wiper 33 comes in contact with the left end (one end) of the nozzle formation surface 22 with the cover head 24 therebetween while being deformed so as to be slightly bent to the left. While the wiper 33 is in a stationary state, when the carriage 16 is further displaced towards the left side, as illustrated in FIG. 8, the wiper 33 is relatively displaced from the left end (one end) of the nozzle formation surface 22 towards the right end (the other end) of the nozzle formation surface 22 along the wiping direction, which is a direction extending from the left side to the right side.

With the above, the wiper 33 carries out wiping of the cover head 24 and the nozzle formation surface 22. At this time, ink adhered to the cover head 24 and the nozzle formation surface 22 is captured by the upper end portion of the wiper 33 and, further, ink meniscus inside each nozzle 21 is regulated by the wiper 33.

Figure 9:
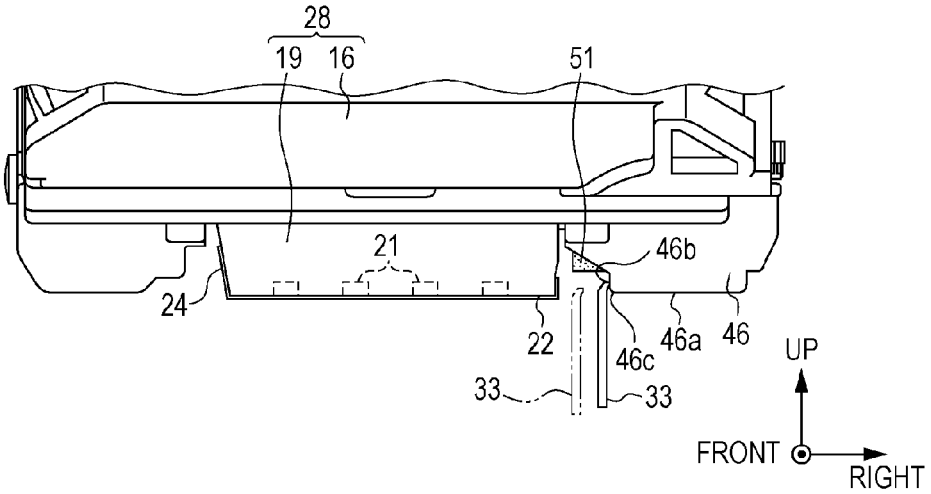
FIG. 9 is a schematic diagram illustrating a state in which the wiper is in contact with a scraper.

While the wiper 33 is in a stationary state, when the carriage 16 is further displaced towards the left side, as illustrated in FIG. 9, the wiper 33 is displaced past the right end (the other end) of the nozzle formation surface 22. Then, when the wiper 33 is relatively displaced to a position between the right end (the other end) of the nozzle formation surface 22 and the scraper 46 (the position illustrated by a two-dot chain line in FIG. 9), the carriage 16 is stopped. At this time, there are cases in which a small amount of ink is scattered due to a biasing force acting on the wiper 33 when the upper end portion of the wiper 33, which has been deformed so as to be bent to the left, returns to its original shape by elastic restoring force; however, a portion of the scattered ink is received and absorbed by the liquid absorbing material 51 positioned above the wiper 33.

Subsequently, the wiper 33 is elevated such that the wiper 33 is adjusted to a height that allows the scraping surface 46*b* and the upper end portion of the wiper 33 to interfere with each other. Subsequently, while the wiper 33 is in a stationary state, when the carriage 16 is displaced towards the left side, as illustrated in FIG. 9, the wiper 33 is relatively displaced to a position where the upper end portion of the wiper 33 abuts against the scraping surface 46*b* (the position illustrated by a solid line in FIG. 9).

At this time, ink that has been captured by the upper end portion of the wiper 33 adheres to the scraping surface 46*b* and, further, the upper end portion of the wiper 33 applies pressing force to the ink adhered to the scraping surface 46*b*. Then, as illustrated in FIGS. 5 and 9, most of the ink adhered to the scraping surface 46*b* is forced up and is made to flow into the groove 53 with the pressing force of the upper end portion of the wiper 33. At this time, a passage of ink that heads towards the groove 53 is formed on the scraping surface 46*b* by the flowing ink. Furthermore, with capillarity, the ink that has flowed into the groove 53 is guided to the far side of the groove 53 and is absorbed and retained by the liquid absorbing material 51.

Figure 10:
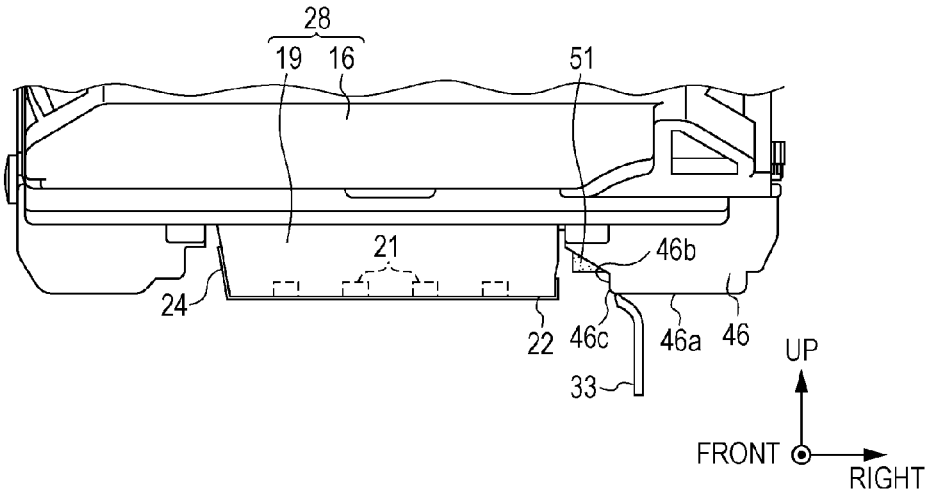
FIG. 10 is a schematic diagram illustrating a state when ink adhered to the wiper is scraped off by the scraper.

While the wiper 33 is in a stationary state, when the carriage 16 is further displaced towards the left side, as illustrated in FIG. 10, the wiper 33 is relatively displaced to the bottom surface 46*a* of the scraper 46 while the wiper 33 is deformed such that the upper end portion of the wiper 33 is slightly bent to the left. At this time, the upper end portion of the wiper 33 is rubbed against the corner portion 46*c* of the scraper 46; accordingly, the remaining ink captured in the upper end portion of the wiper 33 is rubbed onto the scraping surface 46*b*. In other words, the remaining ink that has been captured by the wiper 33 is scraped off by the scraper 46 and is removed from the wiper 33.

Furthermore, as illustrated in FIGS. 5 and 10, the remaining ink that has been rubbed onto the scraping surface 46*b* with the wiper 33 is guided to the groove 53 through the passage of ink formed on the scraping surface 46*b*. In other words, absorption of ink inside the groove 53 by the liquid absorbing material 51 causes the ink on the scraping surface 46*b* to be guided to the groove 53 through the passage of ink. Then, the ink that has been guided to the groove 53 is absorbed and collected by the liquid absorbing material 51. After that, the carriage 16 is displaced to the printing area, and printing is started.

As described above, the ink that has been captured in the wiper 33 can be absorbed by the liquid absorbing material 51 without the wiper 33 and the liquid absorbing material 51 coming in contact with each other. Accordingly, a fragment of the liquid absorbing material 51 and the ink, which had been absorbed by the liquid absorbing material 51 and which has solidified, do not adhere to the wiper 33. As a result, ink adhered to the wiper 33 can be absorbed by the liquid absorbing material 51 while suppressing degradation of the wiping performance of the wiper 33.

According to the detailed description of the exemplary embodiment described above, the following effects can be obtained.

(1) The ink adhered to the wiper 33 after the nozzle formation surface 22 had been wiped is scraped off onto the scraping surface 46*b* and, accordingly, is adhered to the scraping surface 46*b*. Then, the ink adhered to the scraping surface 46*b* is absorbed by the liquid absorbing material 51 from the upper end portion of the scraping surface 46*b*. Accordingly, the ink adhered to the wiper 33 can be absorbed by the liquid absorbing material 51 without the wiper 33 and the liquid absorbing material 51 coming in contact with each other; therefore, no fragment of the liquid absorbing material 51 and no ink, which had been absorbed by the liquid absorbing material 51 and which has solidified, will adhere to the wiper 33. As a result, ink adhered to the wiper 33 can be absorbed by the liquid absorbing material 51 while suppressing degradation of the wiping performance of the wiper 33.

(2) The liquid absorbing material 51 is disposed in the carriage 16; accordingly, the ink that has been absorbed by the liquid absorbing material 51 can be prevented from dripping down.

(3) The liquid absorbing material 51 has a rectangular thin-plate-shape, and among the six sides of the liquid absorbing material 51, the bottom surface 51*b* that has a relatively large area is disposed so as to be in contact with the bottom surface 52*a* inside the accommodation recess 52 that constitutes a portion of the inner bottom surface of the carriage 16. Accordingly, the retention of ink in the liquid absorbing material 51 is facilitated.

(4) The upper end portion of the scraping surface 46*b*, which is a portion of the scraping surface 46*b* on the liquid absorbing material 51 side, is provided with a C-chamfer; accordingly, the groove 53 is formed between the C-chamfered portion of the scraping surface 46*b* and the liquid absorbing material 51. Accordingly, ink accumulated in the groove 53 facilitates the ink adhered to the scraping surface 46*b* to be guided to the groove 53 through the passage of ink on the scraping surface 46*b* and, consequently, facilitates the ink to be guided to the liquid absorbing material 51.

Modifications

Note that the exemplary embodiment described above may be modified as follows.

The upper end portion of the scraping surface 46*b*, which is the end portion of the scraping surface 46*b* on the liquid absorbing material 51 side, may be provided with an R-chamfer rather than the C-chamfer, alternatively, no chamfer may be provided.

The liquid absorbing material 51 does not necessarily have to be formed in a rectangular thin-plate-shape.

The liquid absorbing material 51 does not necessarily have to be disposed so that the bottom surface 51*b*, which is a surface with a relatively large area among the six surfaces of the liquid absorbing material 51, is in contact with the bottom surface 52*a* inside the accommodation recess 52, which constitutes a portion of the inner bottom surface of the carriage 16. In other words, the liquid absorbing material 51 may be disposed so that a surface with a relatively small area among the six surfaces of the liquid absorbing material 51 is in contact with the bottom surface 52*a* inside the accommodation recess 52.

The liquid absorbing material 51 does not necessarily have to be disposed inside the carriage 16. In other words, the liquid absorbing material 51 may be arranged at any position outside the carriage 16 that does not come in contact with the wiper 33.

The ink residing in the groove 53 may be absorbed by a liquid absorbing material different from the liquid absorbing material 51.

One or more grooves or ribs that extend towards the liquid absorbing material 51 side may be formed on the scraping surface 46*b* so that the ink adhered to the scraping surface 46*b* can be easily moved towards the liquid absorbing material 51 side. In such a case, it is preferable that no grooves or ribs are formed on the scraping surface 46*b* in the area where the wiper 33 comes in contact.

The motion of adjusting the height of the wiper 33 so that the upper end portion of the wiper 33 interferes with the scraping surface 46*b* at a position between the right end in the left-right direction of the nozzle formation surface 22 and the scraper 46 may be carried out while displacing the carriage 16.

When the nozzle formation surface 22 is wiped by the wiper 33, the wiper 33 may be displaced from the left side to the right side while the liquid ejection unit 28 is stationary, alternatively, the liquid ejection unit 28 may be displaced from the right side to the left side while the wiper 33 is displaced from the left side to the right side.

The groove 53 may be formed intermittently in the front-rear direction.

The cover head 24 may be omitted.

The liquid ejection head 19 may be of a fixed type such as a so-called line head type rather than of a type that is reciprocated by the carriage 16.

The supply source of ink serving as the liquid that is ejected from the liquid ejection head 19 is not limited to the ink cartridges 26 that are mounted in the carriage 16. The supply source of ink may be ink containers provided inside the main body case 12 that is outside the carriage 16 or may be ink containers provided outside the main body case 12.

The humectant included in the ink may be a humectant other than glycerin or betaine, or the ink may include no humectant.

A communication hole serving as a communication portion that is in communication with the inside of the carriage 16 may be provided in the upper surface of the accommodation recess 52 inside the carriage 16. With such a configuration, since the upper portion of the carriage 16 is in communication with the atmosphere, evaporation of the solvent component of the ink absorbed by the liquid absorbing material 51 can be facilitated.

In the exemplary embodiment described above, the liquid ejection apparatus may be a liquid ejection apparatus that ejects or discharges liquid other than ink. Note that the state of the liquid ejected as minute amounts of droplets from the liquid ejection apparatus includes a granular shape, a tear shape, or a shape with a threadlike trail. Furthermore, liquid used herein refers to any material that can be ejected from the liquid ejection apparatus. For example, any material in a liquid state is sufficient and the ink may include a fluid body, such as a fluid body with high or low viscosity, sol, gel water, other inorganic solvents, an organic solvent, a solution, liquid resin, liquid metal (metallic melt). Furthermore, not just liquid as a state of matter, the ink includes particles of functional material including a solid body such as pigment or metal particle that is dissolved, dispersed, or mixed in a solvent. A representative example of the liquid includes ink, liquid crystal, and others that have been described in the exemplary embodiment described above. Note that ink includes a variety of liquid compositions such as a general aqueous ink, solvent ink, and gel ink, and a hot melt ink. Examples of the liquid ejection apparatus may include, for example, a liquid ejection apparatus that ejects liquid that includes therein, in a dispersed or dissolved manner, a material such as an electrode material or a color material that is used to manufacture liquid crystal displays, electroluminescence (EL) displays, surface emitting displays, and color filters. Furthermore, the liquid ejection apparatus may include, for example, a liquid ejection apparatus that ejects bioorganic matter to manufacture biochips, a liquid ejection apparatus used as a precision pipette that ejects liquid serving as a sample, printing equipment, and a microdispenser. Furthermore, the liquid ejection apparatus may be adopted by a liquid ejection apparatus that ejects lubricating oil in a pinpoint manner onto a precision instrument such as a clock or a camera, a liquid ejection apparatus that sprays transparent liquid resin such as ultraviolet curing resin on a substrate in order to form a hemispherical microlens (optical lens) used in optical communication elements. Furthermore, the liquid ejection apparatus may be a liquid ejection apparatus that ejects acid, alkaline, or another etching solution for etching substrates and the like.

Furthermore, a technical idea that can be ascertained with the exemplary embodiment described above will be described below.

(a) The liquid ejecting apparatus according to any one of claims 1 to 4, wherein the liquid absorbing material is disposed so as to form a corner portion together with the scraping surface.

CROSS REFERENCES TO RELATED APPLICATIONS

The entire disclosure of Japanese Patent Application No. 2013-165206, filed Aug. 8, 2013 is expressly incorporated by reference herein.

What is claimed is:

1. A liquid ejection apparatus, comprising:

a liquid ejection unit that includes a nozzle formation surface, the nozzle formation surface having an opening of a nozzle for ejecting liquid formed therein;

a wiper disposed so as to be capable of coming in contact with the nozzle formation surface;

a transport member capable of relatively displacing the liquid ejection unit and the wiper in a wiping direction that extends along the nozzle formation surface;

a controller that controls the transport member such that the wiper is relatively displaced from one end to other end of the nozzle formation surface in the wiping direction while the wiper is in contact with the nozzle formation surface;

a liquid collection portion disposed on the other end side of the nozzle formation surface of the liquid ejection unit so as to be spaced apart from the nozzle formation surface in the wiping direction, the liquid collection portion being capable of collecting the liquid adhered to the wiper; and the liquid collection portion including a scraper having a scraping surface that scrapes off the liquid adhered to the wiper by coming in contact with the wiper, and the liquid absorbing material that is disposed at a position that does not come in contact with the wiper and at a position that comes in contact with an end portion of the scraping surface, the liquid absorbing material being disposed in a carriage of the liquid ejecting unit.

2. The liquid ejection apparatus according to claim 1, wherein the liquid ejection unit includes a liquid ejection head having the nozzle formation surface, the carriage is box shaped having a bottom, the carriage supporting the liquid ejection head such that the nozzle formation surface is exposed through an opening formed in a bottom wall of the carriage, and the liquid absorbing material is disposed in the carriage such that the liquid absorbing material is in contact with the end portion of the scraping surface through the opening.

3. The liquid ejection apparatus according to claim 2, wherein the liquid absorbing material has a plate shape and is disposed such that, among the plurality of surfaces of the liquid absorbing material, a surface that has a relatively large area is in contact with an inner bottom surface of the carriage.

4. The liquid ejection apparatus according to claim 1, wherein the end portion of the scraping surface on a liquid absorbing material side is chamfered.

5. The liquid ejection apparatus according to claim 1, wherein the scraping surface is provided with a groove or a rib that extends towards the liquid absorbing material.

6. The liquid ejection apparatus according to claim 1, wherein the controller controls the transport member such that the wiper is relatively displaced from the one end towards the other end in the wiping direction while the wiper is in contact with the nozzle formation surface and such that the wiper is displaced past the scraper while a tip of the wiper and the scraping surface are capable of interfering with each other.

7. The liquid ejection apparatus according to claim 6, wherein the controller controls the transport member such that the wiper stops at a position between the other end and the scraper.

8. A liquid ejection apparatus, comprising:

a liquid ejection unit that includes a nozzle formation surface, the nozzle formation surface having an opening of a nozzle for ejecting liquid formed therein;

a wiper disposed so as to be capable of coming in contact with the nozzle formation surface;

a transport member capable of relatively displacing the liquid ejection unit and the wiper in a wiping direction that extends along the nozzle formation surface;

a controller that controls the transport member such that the wiper is relatively displaced from one end to other end of the nozzle formation surface in the wiping direction while the wiper is in contact with the nozzle formation surface;

a liquid collection portion disposed on the other end side of the nozzle formation surface of the liquid ejection unit so as to be spaced apart from the nozzle formation surface in the wiping direction, the liquid collection portion being capable of collecting the liquid adhered to the wiper; and the liquid collection portion including:

a scraper having a scraping surface that scrapes off the liquid adhered to the wiper by coming in contact with the wiper, and the liquid absorbing material that is disposed at a position that does not come in contact with the wiper and at a position that comes in contact with an end portion of the scraping surface, wherein the controller controls the transport member such that the wiper is relatively displaced from the one end towards the other end in the wiping direction while the wiper is in contact with the nozzle formation surface and such that the wiper is displaced past the scraper while a tip of the wiper and the scraping surface are capable of interfering with each other.

9. The liquid ejection apparatus according to claim 8, wherein the controller controls the transport member such that the wiper stops at a position between the other end and the scraper.

* * * * *